US005172733A

United States Patent [19]

Morohashi et al.

[11] Patent Number: 5,172,733

[45] Date of Patent: Dec. 22, 1992

[54] WEAVING THICK FABRIC BY LIFTING CLOTH FELL

[75] Inventors: Kazuo Morohashi; Hiroshi Matsuyama, both of Tokyo, Japan

[73] Assignee: Nippon Oil Company, Limited, Tokyo, Japan

[21] Appl. No.: 741,725

[22] Filed: Aug. 7, 1991

[30] Foreign Application Priority Data

Aug. 8, 1990 [JP] Japan ..... 2-210770

[51] Int. Cl.[5] ..... D03D 23/00

[52] U.S. Cl. ..... 139/20; 139/188 R

[58] Field of Search ..... 139/20, 188 R, 21, 22

[56] References Cited

U.S. PATENT DOCUMENTS 2,897,843 8/1959 Sherwood et al. ..... 139/188 R
3,207,185 9/1965 Koppelman et al. ..... 139/20
3,818,951 6/1974 Greenwood et al. ..... 139/20

*Primary Examiner*—Andrew M. Falik
*Attorney, Agent, or Firm*—Scully, Scott, Murphy & Presser

[57] ABSTRACT

A method and apparatus for weaving a thick fabric. The method comprises the steps of providing a plurality of vertically stacked layers of textile weave, and weaving a set of wefts into the layers of textile weave. This weaving step, in turn, includes the steps of, for each of the plurality of layers, (i) forming a warp shed from the textile weave of the layer, and (ii) inserting one of the wefts into the formed warp shed. This weaving step is repeated a multitude of times to form the thick fabric. Each of the layers of textile weave forms a cloth fell; and the method of this invention further includes the step of vertically moving the layers of textile weave to position the cloth fell of each of the layers at a standard pre-selected weft inserting position when one of the wefts is inserted into the warp shed formed in that layer.

5 Claims, 3 Drawing Sheets

WEAVING THICK FABRIC BY LIFTING CLOTH FELL

FIELD OF THE INVENTION

The present invention relates to a method for weaving a thick fabric and a weaving machine for use in practising the said method.

PRIOR ART

Heretofore, thick fabric weaving methods have been known in which warp sheds are formed simultaneously by a number corresponding to plural textile weaves which constitute a thick fabric, then wefts are inserted into the warp sheds respectively, followed by beating, to form plural textile weaves at a time. Methods are also known wherein there is provided only one warp shed and weft is inserted into the said warp shed, followed by beating, to form plural weave layers one by one. The latter method requires a longer weaving time than does the former method, but is advantageous in that it permits the use of a weaving machine of a simpler structure and in that the number of weave layers can be increased.

FIG. 3 is an enlarged view of a principal portion of a weaving machine used for practising the latter method. In the same figure, the reference number 1 denotes a cloth fell guide; the number 2 denotes a thick fabric of three layers guided by the cloth fell guide 1; numerals 3, 4 and 5 denote upper, middle and lower weave layers, respectively; numeral 6 denotes a cloth fell of the thick fabric; number 7 denotes a warp shed; numeral 8 denotes a shuttle; numeral 9 a reed; and numeral 10 a heald. The reed 9 is adapted to move in a to the right and to the left as viewed in FIG. 3 by means of a rotary crank mechanism and to beat each inserted weft to the cloth fell 6 of each textile weave.

An example of the latter weaving method will now be described more specifically with reference to FIGS. 4(*a*)–4(*d*). A lower warp 11 which forms a cloth fell 3*a* of the upper weave layer 3 is raised, while an upper warp 12 with respect to the cloth fell 3*a* as well as upper and lower warps 15, 14, 18, 17 of the middle and lower weave layers 4, 5 and a pile yarn 20 are lowered to form a warp shed 7 and a first weft is inserted, as shown in FIG. 4(*a*), followed by beating of the weft 13 which has been inserted. Next, the upper warp 12 of the upper weave layer and the lower warp 14 of the middle weave layer 4 are raised to form a warp shed 7 and a second weft is inserted, as shown in FIG. 4(*b*), followed by beating of a weft 16 which has been inserted. Further, the upper warp 15 of the middle weave layer 4 and the lower warp 17 of the lower weave layer 5 are raised to form a warp shed 7 and a third weft is inserted, as shown in FIG. 4(*a*), followed by beating of the weft 19. Then, the lower warp 17 of the lower weave layer is lowered, while the upper warp 18 and the pile yarn 20 are raised to form a warp shed 7, and the next weft is inserted, as shown in FIG. 4(*d*). There is formed of fabric of three layers, from upper to lower layer, then from the lower to upper layer, by repeating these operations.

Generally, in the above method, a weft inserting position X and the position of a cloth fell 4*a* of the middle weave layer of the thick fabric are set at the same height, causing no problem in the case of forming the middle weave layer. However, in the case of forming the upper weave layer [FIG. 4(*a*)], the upper warp 12 of the upper weave layer and the pile yarn 20 are positioned above the upper warp 15 of the middle weave layer, and in the case of forming the lower weave layer [FIG. 4(*c*)], the lower warp 17 of the lower weave layer and the pile yarn 20 are positioned below the lower warp 14, so that there is formed a weft inserting obstruction area a (see FIG. 3) and hence the width of the warp shed is substantially narrowed. Consequently, it is necessary to provide a large distance L, between the cloth fell 6 and the weft inserting position, with the result that the reed and the heald move over large distances, and the size of the entire weaving machine becomes larger. The larger the number of textile weave layers which constitute a thick fabric, the more marked such problem.

It is a subject of the present invention to solve the above-mentioned problem; and it is the object of this invention to provide a weaving method which does not permit the formation of a weft inserting obstruction area, in the case of weaving a thick fabric and also provide a weaving machine which is suitable for practising the said weaving method.

SUMMARY OF THE INVENTION

According to the present invention there is provided a method of weaving a thick fabric by performing weft inserting layer by layer for a plurality of textile weave layers 3, 4 and 5 which constitute a thick fabric 2, characterized in that a cloth fell for weft inserting, such as into cloth fells 3*a*, 4*a* and 5*a* of the weave layers 3, 4 and 5, is moved vertically to a predetermined position X.

According to the present invention there is also provided a thick fabric weaving machine having a heald 10 for forming a warp shed 7 for each layer of the thick fabric, a weft inserting device 8 for inserting each of wefts 13, 16 and 19 into the warp shed 7 thus formed, and a reed 9 for beating the thus-inserted wefts 13, 16 and 19 into the cloth fells 3*a*, 4*a* and 5*a*, thereby effecting weft insertion layer by layer for the weave layers 3, 4 and 5. The weaving machine of this invention is characterized in that it is provided with a lift frame 22 for holding the cloth fell 6 of the thick fabric formed, and a synchronizing mechanism 35 for moving the lift frame 22 vertically in interlock with the beating operation.

According to the above method of the present invention, when forming the weave layer 3, which is located above the middle weave layer 4, which itself is disposed at the same height as the weft inserting position X, the cloth fell 6 of the thick fabric is lowered and beating is performed, while when forming the weaving layer 5, which is located below the middle weave layer 4, the cloth fell 6 of the thick fabric is raised and beating is performed, so that the warp shed 7 is almost always formed the same, and the weft inserting obstruction area a of the prior art is not formed when the method of this invention is used. Consequently, the distance L between the cloth fell 6 of the thick fabric and the weft inserting position X and the stroke of the heald 10 can be reduced, thus permitting the reduction in size of the weaving machine.

BRIEF DESCRIPTION OF THE DRAWINGS

The present invention will be described in detail hereinunder with reference to the accompanying drawings.

DETAILED DESCRIPTION OF THE PREFERRED EMBODIMENTS OF THE INVENTION

Figure 2:
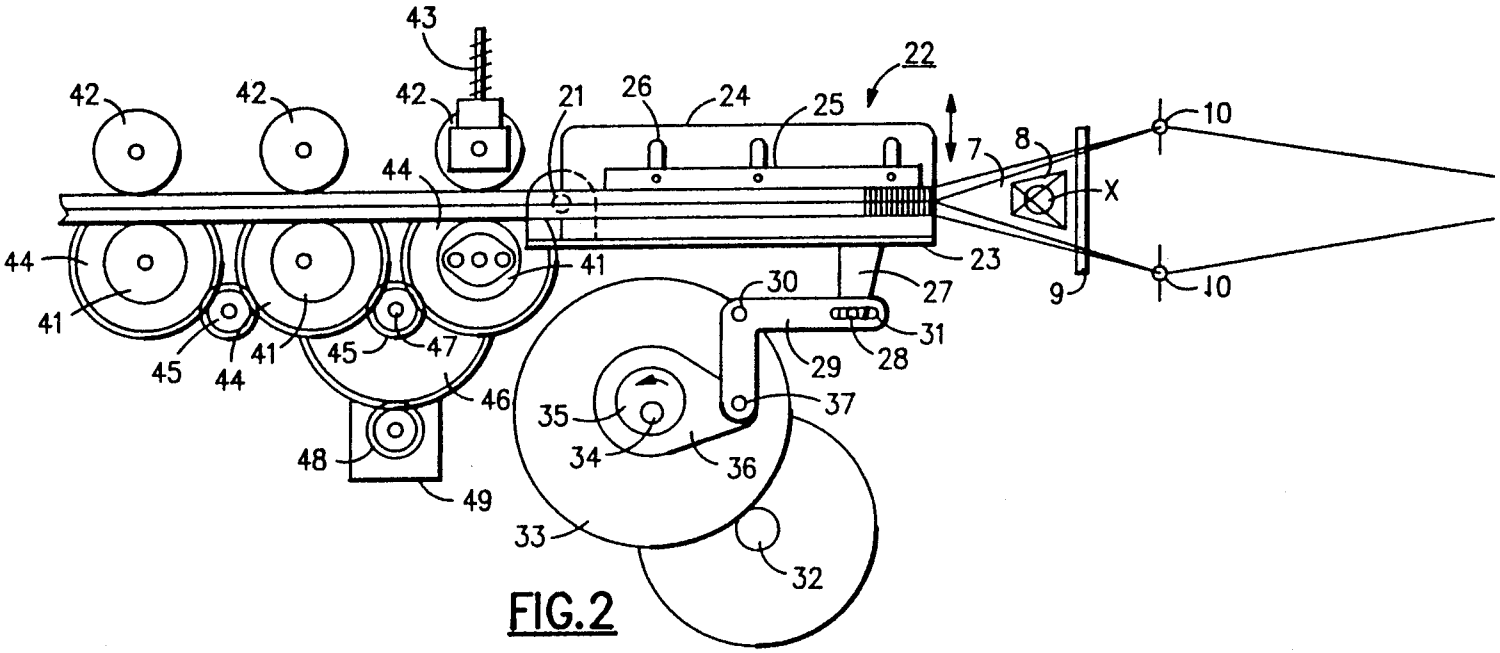
FIG. 2 is an enlarged view of a main portion of a weaving machine used for practicing the weaving method of the present invention.
Figure 3:
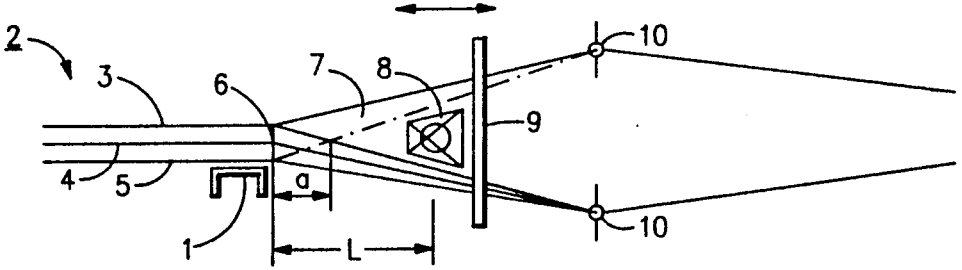
FIG.3 Prior Art
FIG. 3 is an explanatory view of a conventional weaving method.
Figure 4:
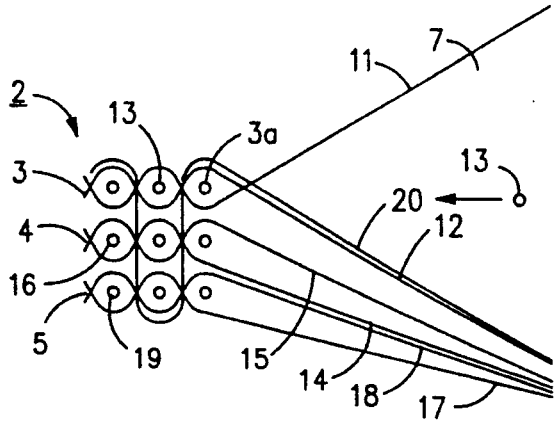
FIG.4 (a) Prior Art
FIGS. 4(*a*)–4(*d*) are detailed explanatory views illustrating a conventional weaving process.
Figure 4:
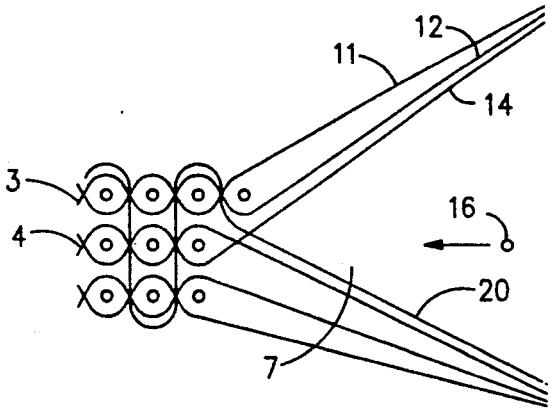
Figure 4:
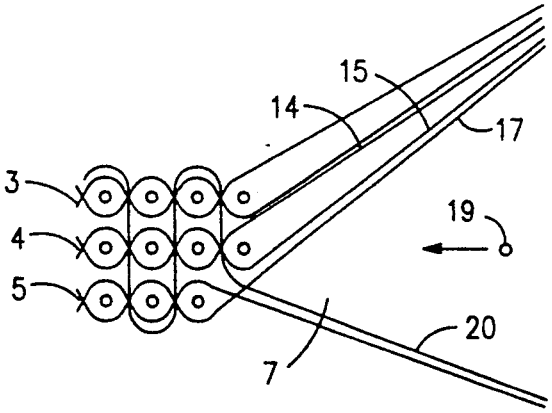
Figure 4:
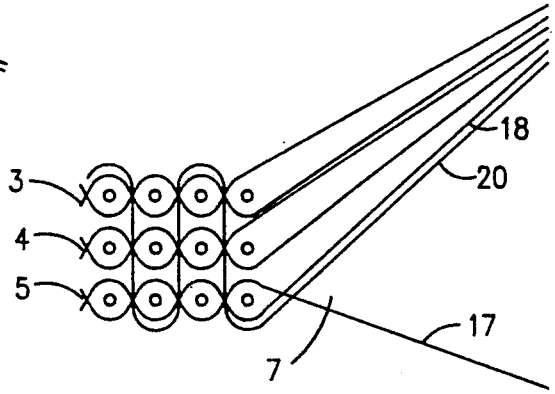

FIG. 2 illustrates an apparatus for practising the weaving method of the present invention. In the same figure, the elements that are the same as those explained above in the prior art are indicated by the same reference numerals and the explanation thereof will be omitted. The numeral 21 denotes a pin implanted in a weaving machine frame (not shown); numeral 22 denotes a lift frame supported pivotably by the pin 21; numeral 23 denotes a bottom plate of the lift frame; numeral 24 denotes a side plate of the lift frame; numeral 25 denotes a presser plate fixed to the side plate 24, vertically adjustable through elongated holes 26; numeral 27 denotes a bracket suspended from the bottom plate 23 of the lift frame; numeral 28 denotes a roller supported through a shaft by a front end of the bracket; numeral 29 denotes an inverted L-shaped link supported pivotably by a stationary pin 30; and numeral 31 denotes an elongated hole formed in one end of the link 29, with the roller 28 being loosely fitted in the elongated hole 31.

Numeral 32 denotes a pinion disposed below the lift frame 22; numeral 33 denotes a wheel which is in mesh with the pinion 32; numeral 35 denotes an eccentric sleeve fixed on to a shaft 34 of the wheel; and numeral 36 denotes an arm supported by the eccentric sleeve 35. A front end of the arm 36 and the other end of the link 29 are interconnected through a pin 37.

Numeral 41 denotes a driving roller for moving the thick fabric intermittently; numeral 42 denotes a hold-down roller disposed just above the driving roller; numeral 43 denotes a compression spring which urges the hold-down roller to the driving roller side; numeral 44 denotes a gear fixed to a shaft of the driving roller; numeral 45 denotes a connecting gear which connects adjacent gears 44 with each other; numeral 46 denotes an intermediate gear fixed to a shaft 47 of the right-hand side connecting gear 45; numeral 48 denotes a driving gear which is in mesh with the intermediate gear 46; and numeral 49 denotes a motor.

The pinion 32 rotates in synchronism with the beating operation of the weaving machine, and the pinion 32—wheel 33 reduction ratio is twice the number of weave layers of a fabric (for example, the reduction ratio is 6 in the case of a three-layer fabric). The wheel 33 causes the eccentric sleeve 35 to rotate, and when the eccentric sleeve 35 rotates once, the lift frame 22 reciprocates once. That is, in forming a three-layer fabric, the lift frame 22 reciprocates once while beating is performed six times.

Figure 1:
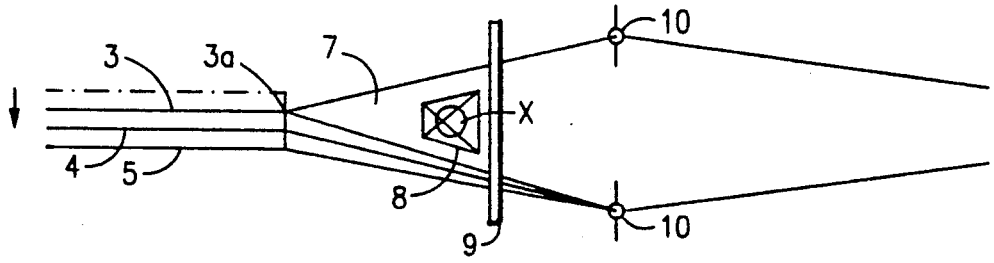
FIGS. 1(*a*), 1(*b*), and 1(*c*) are explanatory views illustrating a weaving method according to the present invention.
Figure 1:
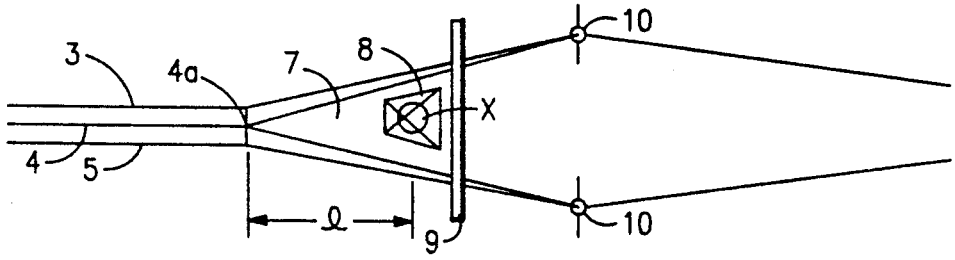
Figure 1:
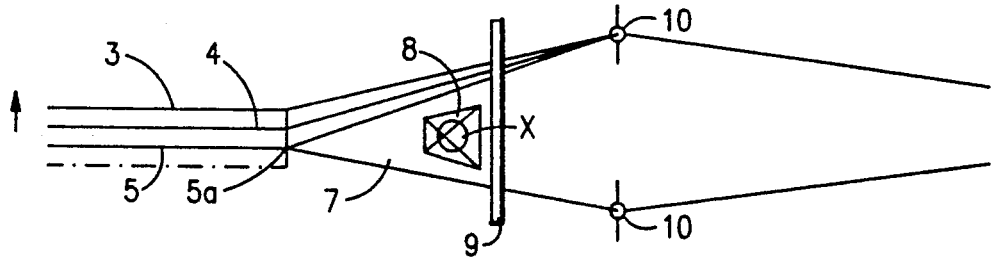

The method of the present invention will now be described with reference to FIGS. 1(*a*) to 1(*c*). Beating is performed in the state of FIG. 2 showing a middle weave layer forming step for a thick fabric, and the eccentric sleeve 35 is turned 60° leftwards in the figure, causing the lift frame 22 to move down and the cloth fell 3*a* of the upper weave layer to go down to the height of the weft inserting position X, then weft is inserted into the warp shed 7, followed by beating, as illustrated in FIG. 1(*a*). Next, the eccentric sleeve 35 is turned 60° leftwards (at this time the lift frame passes the bottom dead center and the height before the rotation and the after the rotation do not change), and again there are performed weft inserting and beating in the position shown in FIG. 1(*a*). Then, the eccentric sleeve 35 is turned 60° leftwards to move the cloth fell 4*a* of the middle weave layer 4 to the height of the weft inserting position X, and in this state weft is inserted into the warp shed 7, followed by beating (b). Further, the eccentric sleeve 35 is turned 60° leftwards to the heald, thus permitting the reduction in size of the weaving machine.

What is claimed is:

1. A method of weaving a thick fabric, comprising:

providing a plurality of vertically stacked layers of textile weave;

weaving a set of wefts into the layers of textile weave to form a respective cloth fell in each of said layers, including the steps of for each of the plurality of layers, i) forming a warp shed from the textile weave of the layer, and ii) inserting one of the wefts into the formed warp shed;

repeating the weaving step a multitude of times to form the thick fabric; and vertically moving the layers of textile weave to position the cloth fell of each of the layers at a standard pre-selected weft inserting position when one of the wefts is inserted into the warp shed formed in said each of the layers.

2. A method according to claim 1, further including the step of beating the inserted wefts into the cloth fells; and wherein the moving step includes the step of vertically moving the cloth fells in interlock with the beating step.

3. A machine for weaving a thick fabric, comprising:

support means to support a plurality of vertically stacked layers of textile weave;

a heald to form warp sheds in each of said layers of textile weave;

weft inserting means to insert weft into the warp sheds formed in said layers; and a reciprocating reed to reciprocate in first and second opposite directions to beat the wefts into cloth fells, layer by layer, and to form the thick fabric;

wherein the support means includes i) a vertically movable lift frame to hold the cloth fells, and ii) synchronizing means to move the lift frame and the cloth fells vertically in interlock with reciprocating movement of the reed.

4. A machine according to claim 3, wherein each of the layers of textile weave has a respective one of the cloth fells; and the lift frame positions the cloth fell of each of the layers at a standard pre-selected weft receiving position when one of the wefts is inserted into the warp shed of said each of the layers.

5. A machine according to claim 3, wherein the synchronizing means includes:

a rotatable wheel;

an arm supported for upward and downward movement;

an eccentric cam mounted on the rotatable wheel for rotation therewith, and engaging the arm to raise and lower said arm as the cam rotates with the wheel; and a link connected to the arm and to the lift frame, to raise and lower the lift frame and the cloth fells as the arm is raised and lowered.

* * * * *

UNITED STATES PATENT AND TRADEMARK OFFICE

CERTIFICATE OF CORRECTION

PATENT NO. : 5,172,733

DATED : December 22, 1992

INVENTOR(S) : Kazuo Morohashi, et al.

It is certified that error appears in the above-identified patent and that said Letters Patent is hereby corrected as shown below:

Column 1, lines 27, 28 & 32: "number" should read as --numeral--

Column 1, line 51: "of a" should read as --of the--

Column 1, line 55: "4(a)" should read as --4(c)--

Column 1, line 59: "of" should read as --a--

Column 2, lines 21-22: "also provide" should read as --also to provide--

Column 2, line 60: "permitting the reduction in size" should read as --permitting a reduction in the size--

Signed and Sealed this

Fourteenth Day of December, 1993

Bruce Lehman

*Attest:*

BRUCE LEHMAN

*Attesting Officer*

*Commissioner of Patents and Trademarks*